US007721796B2

(12) United States Patent
Kalbacher

(10) Patent No.: US 7,721,796 B2
(45) Date of Patent: May 25, 2010

(54) HEAT EXCHANGER FOR MULTIPLE COOLING LOOPS

(75) Inventor: Klaus Kalbacher, Rangendingen (DE)

(73) Assignee: Modine Manufacturing Company, Racine, WI (US)

( * ) Notice: Subject to any disclaimer, the term of this patent is extended or adjusted under 35 U.S.C. 154(b) by 836 days.

(21) Appl. No.: 11/369,800

(22) Filed: Mar. 7, 2006

(65) Prior Publication Data

US 2006/0207755 A1 Sep. 21, 2006

(30) Foreign Application Priority Data

Mar. 16, 2005 (DE) ..... 10 2005 012 082

(51) Int. Cl.
*F28F 9/02* (2006.01)

(52) U.S. Cl. ..... 165/174; 165/97; 165/167; 165/175

(58) Field of Classification Search ..... 165/71, 165/72, 96, 97, 108, 110, 140, 143, 144, 165/157, 164, 167, 171, 173, 174, 175, 176, 165/177, 178

See application file for complete search history.

(56) References Cited

U.S. PATENT DOCUMENTS

| | | | | | |
|---|---|---|---|---|---|
| 2,776,092 | A * | 1/1957 | Collins, Jr. | ..... | 165/108 |
| 3,731,734 | A * | 5/1973 | Ris et al. | ..... | 165/174 |
| 3,743,011 | A * | 7/1973 | Frost | ..... | 165/167 |
| 3,990,504 | A * | 11/1976 | Kolthoff, Jr. | ..... | 165/97 |
| 4,287,945 | A * | 9/1981 | Hessari | ..... | 165/174 |
| 4,303,124 | A * | 12/1981 | Hessari | ..... | 165/174 |
| 4,993,367 | A * | 2/1991 | Kehrer | ..... | 165/160 |
| 5,141,048 | A * | 8/1992 | Sausner | ..... | 165/174 |
| 5,651,268 | A * | 7/1997 | Aikawa et al. | ..... | 165/174 |
| 5,826,649 | A * | 10/1998 | Chapp et al. | ..... | 165/174 |
| 5,915,464 | A * | 6/1999 | Kalbacher et al. | ..... | 165/174 |
| 5,934,552 | A * | 8/1999 | Kalbacher et al. | ..... | 236/12.2 |
| 5,950,715 | A * | 9/1999 | Jonsson et al. | ..... | 165/167 |
| 6,039,263 | A * | 3/2000 | Kalbacher et al. | ..... | 236/93 A |
| 6,182,749 | B1 * | 2/2001 | Brost et al. | ..... | 165/167 |
| 6,199,401 | B1 * | 3/2001 | Haussmann | ..... | 165/174 |
| 2008/0210410 | A1 * | 9/2008 | Kalbacher et al. | ..... | 165/157 |

FOREIGN PATENT DOCUMENTS

| | | | |
|---|---|---|---|
| DE | 38 24 073 | A1 * | 2/1990 |
| DE | 196 11 447 | C1 * | 7/1997 |
| EP | 0 8181 663 | A2 * | 1/1998 |

* cited by examiner

*Primary Examiner*—Ljiljana (Lil) V Ciric
(74) *Attorney, Agent, or Firm*—Michael Best & Friedrich LLP

(57) ABSTRACT

A heat exchanger, including first and second collecting tanks with an inlet, an outlet, and an opening through a wall of the first tank. At least one row of tubes extends between the collecting tanks, and the tubes and tanks carry a first medium and a second medium flows through the spaces between the tubes. A first partition divides the first collecting tank and defines an opening therethrough, and a second partition divides the second collecting tank, with the first and second partitions defining separate loops for the first medium when the first partition opening is closed. A discharge device selectively either simultaneously opens both the first collecting tank opening and the first partition opening for emptying or simultaneously closes both the first collecting tank opening and the first partition opening for operation.

6 Claims, 3 Drawing Sheets

HEAT EXCHANGER FOR MULTIPLE COOLING LOOPS

CROSS REFERENCE TO RELATED APPLICATION(S)

Not applicable.

STATEMENT REGARDING FEDERALLY SPONSORED RESEARCH OR DEVELOPMENT

Not applicable.

REFERENCE TO A MICROFICHE APPENDIX

Not applicable.

TECHNICAL FIELD

The present invention relates to a heat exchanger, and more particularly to a heat exchanger usable in systems having heat exchange loops passing separately through the heat exchanger.

BACKGROUND OF THE INVENTION AND TECHNICAL PROBLEMS POSED BY THE PRIOR ART

A radiator type heat exchanger is disclosed in EP 818 663 B1, in which two collecting tanks are arranged on opposite sides with longitudinal and end walls, as well as with a number of openings, each of which accommodates a tube through which a medium flows. The collecting tanks have an inlet and an outlet, and one of the collecting tanks has a partition with an opening which can be closed with a plug. Depending on the design of the employed closure plug, the radiator can be designed with or without a low temperature range. EP 818 663 B1 always involves a single cooling loop which is passed through the radiator. However, in systems in which several independent loops exist, heat exchangers such as disclosed in EP 818 663 B1 cannot be readily used unless several such heat exchangers are provided, each separately openable for emptying the associated loops. Such heat exchangers may require corresponding additional expense. Further, emptying of multiple loops may be correspondingly more difficult and time consuming, with it also being possible to inadvertently fail to empty one of the loops.

The present invention is directed toward overcoming one or more of the problems set forth above.

SUMMARY OF THE INVENTION

In one aspect of the present invention, a heat exchanger is provided, including a first collecting tank having an opening through a wall of the first tank, a second collecting tank, and at least one row of tubes extending between the collecting tanks. The tubes having spaces therebetween and the tubes and tanks are adapted to carry a first medium and a second medium is adapted to flow through the space between the tubes. An inlet is provided in one of the collecting tanks, and an outlet is provided in one of the collecting tanks. A first partition divides the first collecting tank and includes an opening therethrough, and a second partition divides the second collecting tank, with the first and second partitions defining separate loops for the first medium when the first partition opening is closed. A discharge device is adapted to selectively open both the first collecting tank opening and the first partition opening or close both the first collecting tank opening and the first partition opening.

In one form of this aspect of the present invention, the discharge device selectively opens or closes both openings simultaneously.

In another form of this aspect of the present invention, the discharge device includes a rod having one end adapted to plug the first partition opening and the other end plugging the first tank opening, with the rod being mounted for selected removal from the first tank.

In still another form of this aspect of the present invention, the discharge device includes a tubular member open on both ends with one open end defining the first partition opening, and a closure plug at the first tank opening adapted to selectively open or close the first tank opening and the other open end of the tubular member. In a further form, the tubular member is shorter than the distance between the first tank opening and the first partition opening, and the closure plug includes a pin whose cross-section generally corresponds to the cross-section of the tubular opening of the tubular member, with the pin being received in the tubular member tubular opening when the closure plug is in the first tank opening.

In yet another form of this aspect of the present invention, the first and second partitions are at substantially the same height.

DETAILED DESCRIPTION OF THE INVENTION

Figure 1:
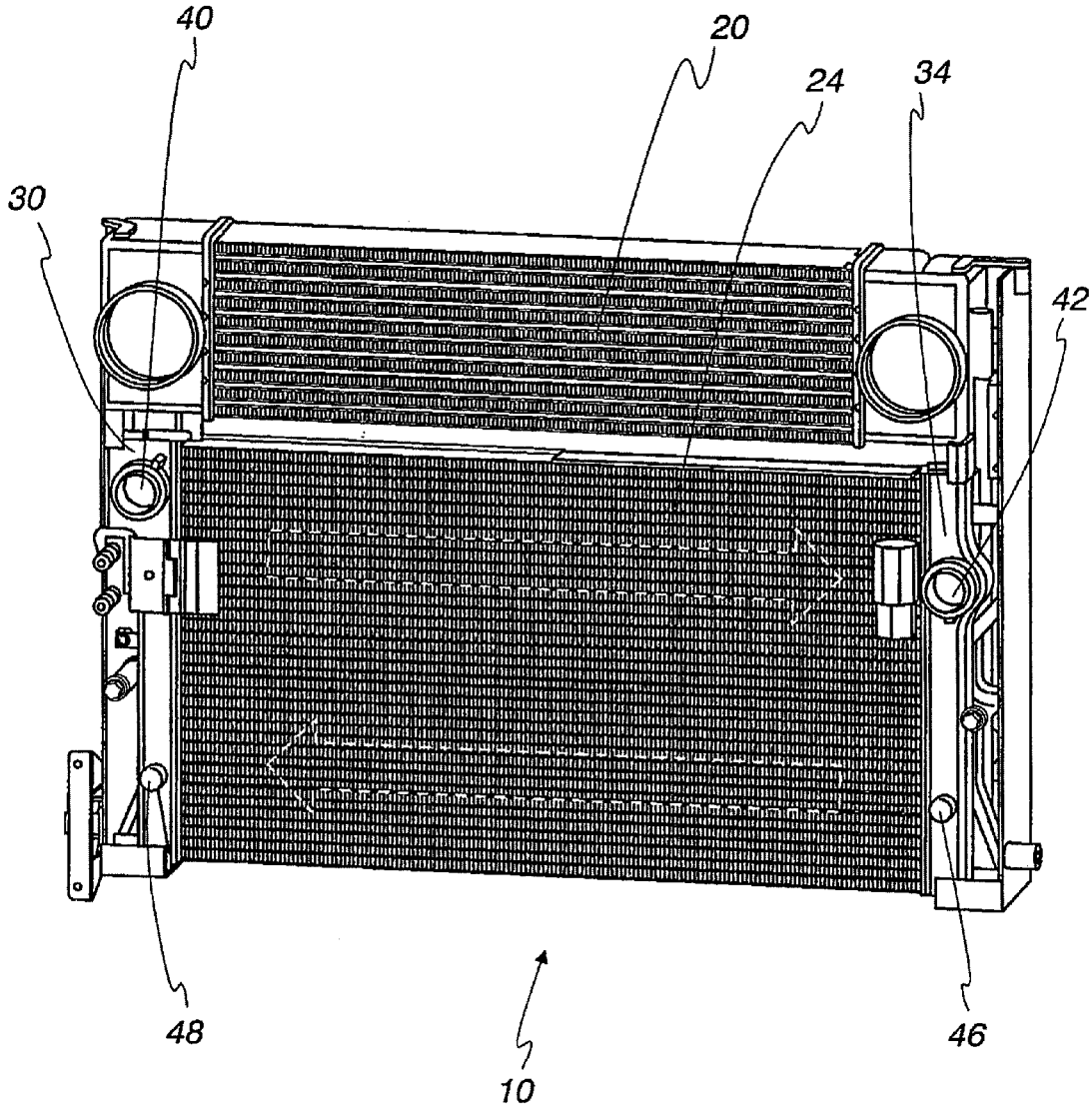
FIG. 1 is a perspective view of one face of a vehicle cooling module according to the present invention.

A first embodiment of a cooling module 10 embodying the present invention is shown in FIG. 1, which includes several heat exchangers, all of which may be advantageously designed as all-metal heat exchangers from aluminum. Such heat exchangers can be recycled without costly material separation, thereby meeting the requirements of both automobile manufacturers and the public, and has been standard for many years.

In the FIG. 1 embodiment, a charge air cooler 20 is located above a radiator 24. The cooling air flows through the cooling module 10, which is usually arranged in the front area of the vehicle. A condenser for the air conditioner and, if necessary, additional heat exchangers (e.g., an oil cooler) are not shown but may also be situated in front of the radiator 24 in the direction of air flow.

The left collecting tank 30 of the radiator 24 has an inlet 40 for the coolant and the right collecting tank 34 has a corresponding outlet 42. However, the inlet 40 and outlet 42 may, alternatively, be situated on the same collecting tank such as is known in the art. This described design represents part of a first loop otherwise not further shown.

An additional loop separate from that which passes through the inlet 40 and outlet 42 as described above is also advantageously provided, but is also not otherwise further shown beyond the portion in the cooling module 10 shown in FIG. 1. Specifically, the coolant from this additional loop enters the lower part of the radiator 24 via inlet 46 on the right collecting tank 34 and leaves this lower part via outlet 48 on the left collecting tank 30.

Since the two loops (not further shown beyond the cooling module 10) are independent of each other, it should be appreciated that the flow direction is arbitrary, and the flow direction described and shown by the arrows in FIG. 1 are merely exemplary.

The coolant, which flows through the lower part of the radiator 24 (between inlet 46 and outlet 48), leaves it with a lower temperature, and may therefore be described as "low temperature flow". The coolant which flows through the upper part of the radiator 24 (between inlet 40 and outlet 42) may be described as "main coolant flow" due to the fact that the first loop there has a much larger mass flow rate (such as may commonly be used to cool the drive machine).

Figure 2:
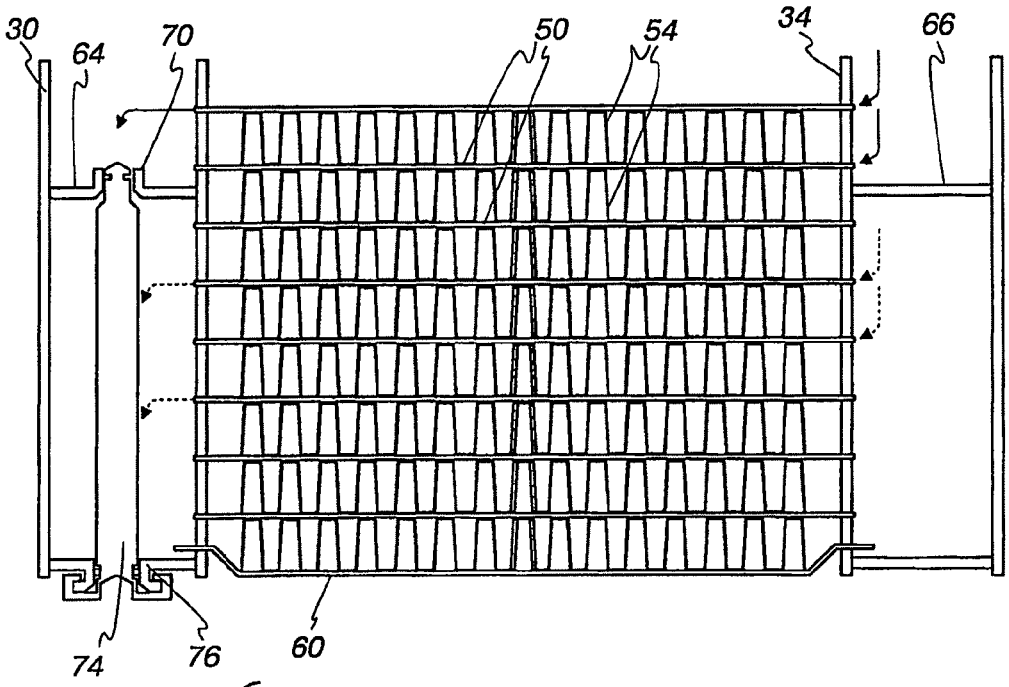
FIG. 2 is a schematic cross-sectional depiction of the lower part of the radiator portion of the FIG. 1 cooling module.

FIG. 2 illustrates the lower part of the radiator 24 somewhat more closely, with some details left out for clarity of illustration. The radiator 24 has one or more rows of flat tubes 50, with corrugated ribs 54 or the like through which the cooling air flows situated between the flat tubes 50. The lower part of radiator 24 is bounded by a side part 60, which connects both collecting tanks 30, 34. Side parts 60, flat tubes 50, corrugated ribs 54 and collecting tanks 30, 34, like the other heat exchangers of the cooling module, may be advantageously designed with solder connections so that intimate contact is present to permit efficient heat exchange between the cooling air and coolant.

As illustrated in FIG. 2, the mentioned two loops are separated by a partition 64 in the left collecting tank 34 and an additional partition 66 in the right collecting tank 30. This separated flow is indicated by the flow arrows with the solid (top) and dashed lines (bottom) in FIG. 2.

In accordance with the present invention, an opening 70 is present in one partition 64, which opening 70 is closed as long as the discharge device 74 remains in the closed position depicted in FIG. 2. Moreover, the discharge device 74 simultaneously closes an opening 76 in the wall of collecting tank 34 in this position. Thus, it should be appreciated that the discharge device 74 will maintain the integrity of the tank 30 when in the position illustrated so as to allow for separate closed flow for both loops, and that the discharge device when removed will open both openings 70 and 76 so that hydraulic separation between the loops is eliminated and the contents of both loops can be readily emptied when so desired.

Figure 3:
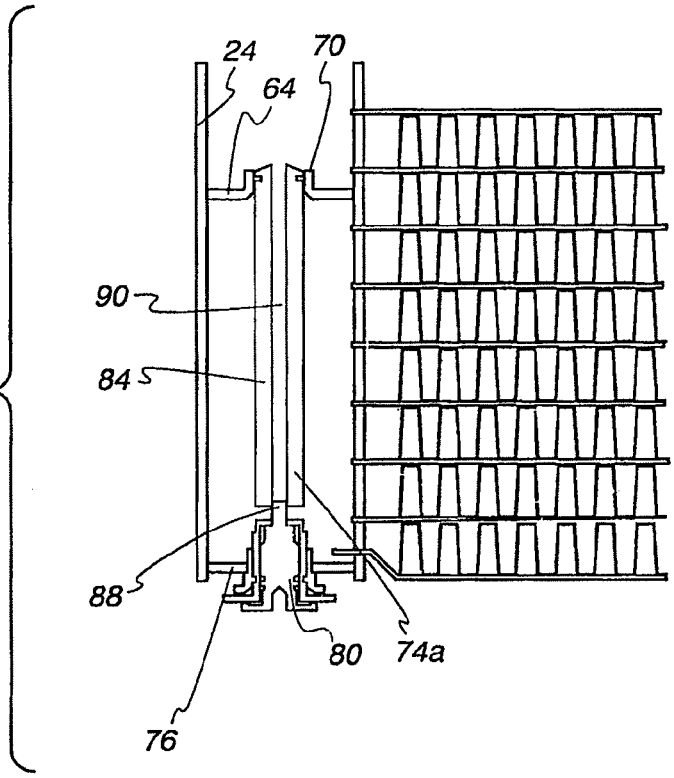
FIG. 3 is a schematic detail view of one side of the lower portion of a radiator portion of a second embodiment of a cooling module according to the present invention.
Figure 4:
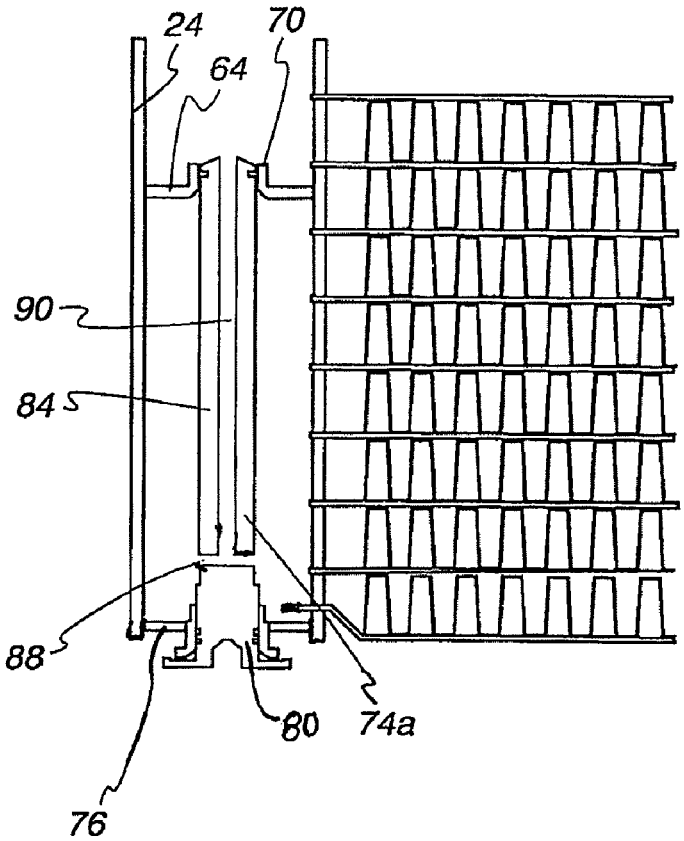
FIG. 4 is a schematic detail view of one side of the lower portion of a radiation portion of a third embodiment of a cooling module according to the present invention.

FIG. 3 shows an alternative of the above described embodiment, in which only a cut-out portion of the lower left side of the radiator 24 is depicted. In this embodiment, the discharge device 74*a* and its operation differ, but the rest is otherwise substantially identical to the FIG. 2 embodiment.

Specifically, in the FIG. 3 embodiment, the discharge device 74*a* includes two parts: a closure plug 80 and a tubular member 84. The closure plug 80 sits in the opening 76 in the bottom wall of collecting tank 34, and has a pin 88 which blocks the passage opening 90 in the tubular member 84. It should be appreciated that removing the closure plug 80 from the tank bottom wall opening 76 will allow both loops to be emptied, with liquid from the upper loop flowing through the passage opening 90 in the tubular member 84, and then draining through opening 76 along with liquid from the lower loop which will also drain through the opening 76. The tubular member 84 can thus provide such operation to empty both loops without requiring that its position be changed.

It should be appreciated that the present invention provides an inexpensive structure which may be conveniently and reliably maintained, with separate heat exchange loops easily emptied when desired. Moreover, the present invention is particularly well suited for applications in which the same media (e.g., coolants) are present in both loops, as the emptied media are then of the same type and can therefore be disposed of together appropriately.

Further, the present invention is particularly advantageous for use in so-called "all-metal heat exchangers", which also have collecting tanks made of metal (e.g., aluminum), because an additional opening in the wall of the collecting tank is avoided. Such openings can be expensive to product in such collecting tanks.

Still other aspects, objects, and advantages of the present invention can be obtained from a study of the specification, the drawings, and the appended claims. It should be understood, however, that the present invention could be used in alternate forms where less than all of the objects and advantages of the present invention and preferred embodiment as described above would be obtained.

The invention claimed is:

1. A heat exchanger, comprising: a first collecting tank having an opening trough a wall of said first tank; a second collecting tank; at least one row of tubes extending between said collecting tanks, said tubes having spaces therebetween, with said tubes and tanks adapted to carry a first medium and a second medium adapted to flow through the spaces between the tubes; an inlet in one of said collecting tanks; an outlet in one of said collecting tanks; a first partition dividing said first collecting tank, said partition defining an opening therethrough; a second partition dividing said second collecting tank, wherein said first and second partitions define separate loops for said first medium when said first partition opening is closed; a discharge device having a first state in which fluid flow through the first collection tank opening and the first partition opening is closed by the discharge device, and a second state in which the first collection tank opening and the first partition opening are opened to fluid flow therethrough.

2. The heat exchanger of claim 1, wherein said discharge device selectively opens or closes both openings simultaneously.

3. The heat exchanger of claim 1, wherein said discharge device includes a rod having one end adapted to plug the first partition opening and the other end plugging the first tank opening, said rod being mounted for selected removal from said first tank.

4. The heat exchanger of claim 1, wherein said discharge device includes a tubular member open on both ends, with one open end defining said first partition opening; and a closure plug at the first tank opening adapted to selectively open or close said first tank opening and the other open end of said tubular member.

5. The heat exchanger of claim 4, wherein said tubular member is shorter than the distance between said first tank opening and said first partition opening, and said closure plug includes a pin whose cross-section corresponds roughly to the cross-section of the tubular opening of said tubular member, said pin being received in said tubular member tubular opening when said closure plug is in said first tank opening.

6. The heat exchanger of claim 1, wherein said first and second partitions are at substantially the same height.

* * * * *